US005156076A

United States Patent [19]

Rosemann

[11] Patent Number: 5,156,076

[45] Date of Patent: Oct. 20, 1992

[54] RADIALLY ADJUSTABLE ANVIL ROLL ASSEMBLY FOR A ROTARY DIE CUTTING PRESS

[76] Inventor: Richard R. Rosemann, 456 S. Clay, St. Louis, Mo. 63122

[21] Appl. No.: 703,661

[22] Filed: May 21, 1991

[51] Int. Cl.[5] ..... B26D 1/62

[52] U.S. Cl. ..... 83/344; 29/110; 83/346; 83/659; 100/168

[58] Field of Search ..... 83/659, 344, 507, 346, 83/347, 506, 591; 72/243.6; 29/110; 100/168, 172

[56] References Cited

U.S. PATENT DOCUMENTS

| | | | |
|---|---|---|---|
| 3,786,709 | 1/1974 | Spengler | 83/344 X |
| 4,553,461 | 11/1985 | Belongia | 83/344 |
| 4,742,745 | 5/1988 | Cremona | 83/344 |
| 4,759,247 | 7/1988 | Bell et al. | 83/344 X |
| 4,770,078 | 9/1988 | Gautier | 83/344 |
| 4,989,487 | 2/1991 | Staley | 83/506 |
| 5,083,488 | 1/1992 | Stanley et al. | 83/344 |

*Primary Examiner*—Frank T. Yost
*Assistant Examiner*—Ken Peterson
*Attorney, Agent, or Firm*—Rogers, Howell & Haferkamp

[57] ABSTRACT

A radially adjustable anvil roll assembly for use in a die cutting cylinder of a rotary die cutting press is comprised of a cylindrical sleeve having an internal bore, a shaft extending longitudinally through the internal bore of the sleeve and supporting the sleeve for rotation thereon, and an adjustable bearing assembly having pluralities of bearer rolls that engage in rolling engagement with an exterior surface of the anvil sleeve and adjustably position the anvil sleeve radially on the shaft, thereby adjusting the radial spacing between the cutting edges of the die cutting cylinder and the anvil surface of the sleeve.

30 Claims, 3 Drawing Sheets

FIG. 1.
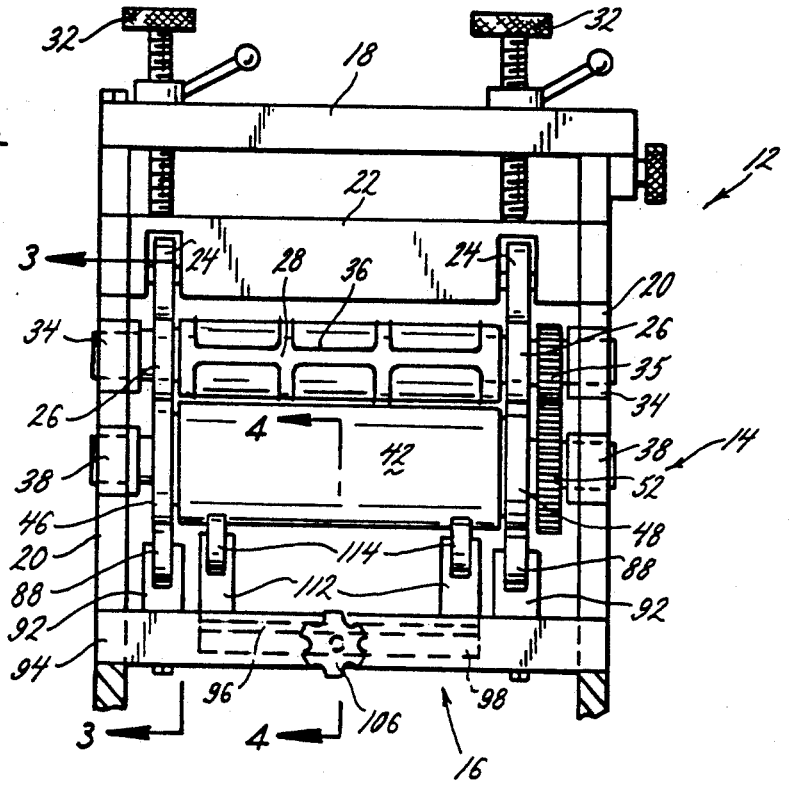
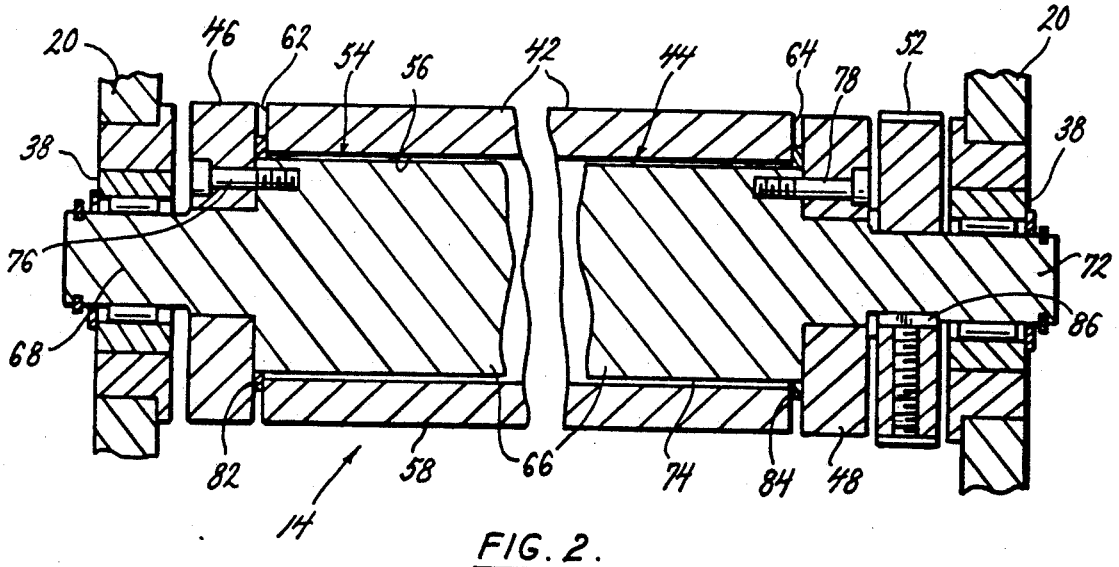
FIG. 2.

RADIALLY ADJUSTABLE ANVIL ROLL ASSEMBLY FOR A ROTARY DIE CUTTING PRESS

BACKGROUND OF THE INVENTION (1) Field of the Invention

The present invention relates to an anvil roll assembly for a rotary die cutting press that is radially adjustable toward and away from the die cutting cylinder of the press.

(2) Description of the Related Art

Prior art rotary die cutting presses are often employed in cutting self-adhesive labels from layered web stock having a label material layer, an adhesive layer, and a backing material layer. The prior art die cutting cylinders employed in the presses for cutting the webs of layered material, and also employed in other similar cutting operations, are generally constructed to suit the particular type of web material employed. The thickness of the web and/or the number of web layers to be cut through must be taken into consideration when determining the clearance between the cutting edges of the die cutting cylinder and the surface of the anvil roll between which the web material is passed. This clearance is determined by the relative spacing between the cutting edges of the die cutting cylinder and the circumferential surfaces of the cutting cylinder's bearer rolls, added to the spacing between the surface of the anvil roll and the circumferential surfaces of the anvil roll's bearer rolls. If the cutting edges of the die cutting cylinder penetrate too far into the layers of the web material, the cutting edges may penetrate the backing layer of the web material causing the backing layer to tear when the cut labels are separated from the backing layer. If, on the other hand, the cutting edges of the die cutting cylinder do not penetrate far enough into the layers of the web material, the depth of the cut will be inadequate to completely penetrate through the label material and the labels will tear when they are separated from the backing material.

One approach to solving the above-described difficulties has been to provide a set of stepped anvil rolls, each cylindrical anvil roll having a different dimensioned outer diameter. The different outer diameters of the anvil rolls will position the anvil roll surfaces at different radial heights relative to the circumferential surfaces of the anvil roll end bearers depending on which anvil roll of the set is assembled on the cutting press. Interchanging the different anvil rolls on the press will adjust the anvil roll surface radially relative to the circumferential surfaces of the anvil roll end bearers, in addition to adjusting the position of the web material relative to the cutting edges of the die cutting cylinder. With a set of stepped anvil rolls, the position of the anvil roll surface relative to the circumferential surfaces of the anvil end bearers and relative to the cutting edges of the die cutting cylinder can be adjusted for web materials of different thicknesses and to compensate for wearing down of the cutting edges of the die cutting cylinder.

However, maintaining a large set of anvil rolls of different outer diameters may not be satisfactory in all situations. Maintaining a large selection of anvil rolls of different outer diameters would be a considerable expense. The manual labor required in replacing the anvil rolls on the press and the down time of the press while such replacements are made also add to the disadvantages of this approach. These shortcomings illustrate the need for an alternate solution to enable adjusting the clearance between an anvil roll surface and the cutting edges of a die cutting cylinder to accommodate the range of conditions encountered in die cutting operations.

In the Reed U.S. Pat. Nos. 4,130,042 and 4,226,150, an assembly is disclosed by which the eccentricities of end bearers of an anvil roll are varied to change the clearance between the anvil roll and cutting cylinder of a press. However, the mechanism disclosed in these patents is relatively complex, and requires that both end bearers be adjusted, thereby introducing the possibility of inaccurate adjustments due to misalignment and clearance variations across the width of the web material.

Furthermore, in related but slightly different applications of rotary presses, web materials are blanked, creased, folded, hinged and scored using rotary dies. Problems similar to those set forth above are encountered in controlling the depth of penetration of the rotary die element in creasing and scoring operations of the press, and in performing creasing and scoring operations on web materials of different thicknesses. In view of the similarities between these operations of the rotary die press and the cutting operation described above, references herein to "cutting" operations should be broadly construed and are intended to be broadly construed to include blanking, creasing, folding, hinging and scoring web materials in addition to other related operations not specifically set forth herein.

What is needed is a novel anvil roll in which the height or radial extension of the cylindrical body portion of the roll, which provides the anvil surface that opposes the cutting edges of a die cutting cylinder, can be varied in relation to the circumference of the end bearers of the anvil roll.

SUMMARY OF THE INVENTION

The radially adjustable anvil roll assembly of the present invention is generally comprised of a hollow cylindrical anvil sleeve, a shaft, and an adjustable bearing block assembly. The component parts of the anvil roll assembly are designed to be assembled onto a conventional rotary die cutting press of the type employing a rotary die cutting cylinder with which the anvil roll sleeve of the present invention operates. By "radial adjustment" what is meant is the anvil surface of the anvil sleeve is adjustable toward and away from the die cutting cylinder of the press.

The anvil sleeve is an elongate cylinder having a hollow internal bore. The cylindrical exterior surface of the sleeve serves as the anvil surface which opposes the cutting edges of the die cutting cylinder.

The shaft is an elongate rod having an axial length longer than the axial length of the sleeve. The shaft has an enlarged center portion and left and right end sections that project from the opposite ends of the center portion. The center portion of the shaft has a constant diameter larger than the diameter of the end sections and an axial length about equal to that of the sleeve.

The shaft of the anvil roll assembly extends through the internal bore of the anvil sleeve and the center portion of the shaft is centered inside the bore of the sleeve. The diameter of the sleeve internal bore is slightly larger than the diameter of the shaft center portion, enabling the sleeve center axis to be displaced slightly from the shaft center axis. The sleeve rotates freely on the center portion of the shaft.

The anvil roll assembly of the invention is mounted on a rotary die cutting press by journalling the opposite end sections of the shaft in bearings mounted on the press. The anvil roll assembly is mounted on the press with the center axes of the anvil sleeve and shaft being parallel to and radially spaced from the center axis of the press die cutting cylinder. The anvil sleeve is rotated by the friction engagement of the sleeve with web material passed between the sleeve and the rotating die cutting cylinder of the press.

The adjustable bearing block assembly includes a pair of wedge shaped plates mounted in the base of the die cutting press. The plates are mounted in the press so that they will slide against each other, causing the top plate of the pair to move vertically, toward and away from the die cutting cylinder of the press. A manual adjustment knob is provided on the press for controlling the sliding movement of the plates, and thereby controlling the vertical adjustment of the top plate toward and away from the die cutting cylinder. A pair of bearing blocks are mounted on the top plate. Each bearing block supports a pair of bearer rolls that are mounted for rotation on each bearing block. By selectively turning the manual knob of the bearing block assembly in opposite directions, the bearer rolls mounted on each bearing block are adjusted vertically toward and away from the die cutting cylinder of the press.

The pairs of bearer rolls engage against the exterior surface of the anvil sleeve. To radially adjust the anvil sleeve of the anvil roll assembly relative to the die cutting cylinder of the rotary die cutting press, the manual adjustment knob of the bearing block assembly is turned to cause the top wedge plate to move vertically either toward or away from the die cutting cylinder of the press. Turning the manual adjustment knob to cause the top plate to move toward the die cutting cylinder raises the bearing blocks and the pairs of bearer rolls they support. Raising and lowering the pairs of bearer rolls causes the anvil sleeve, in rolling engagement with the bearer rolls and rotatably supported by the center portion of the shaft, to move radially relative to the shaft and respectively toward and away from the die cutting cylinder of the press. The radial adjustment of the anvil sleeve relative to the die cutting cylinder is limited by the difference between the internal diameter of the sleeve and the external diameter of the shaft center portion.

By selectively raising and lowering the bearer rolls of the pair of bearing blocks, the anvil sleeve is adjusted between a first position where the sleeve internal bore engages against the underside of the shaft center portion and the sleeve's center axis is radially positioned closest to the center axis of the die cutting cylinder, and a second position where the sleeve internal bore engages against the top of the shaft center portion and the center axis of the sleeve is radially spaced its furthest extent from the center axis of the die cutting cylinder. By selectively raising and lowering the pair of bearing blocks by adjusting the manual knob of the bearing block assembly, the axis of rotation of the sleeve and the sleeve external anvil surface are radially adjusted toward and away from the cutting edges of the die cutting cylinder.

BRIEF DESCRIPTION OF THE DRAWINGS

Further objects and features of the present invention are revealed in the following detailed description of the preferred embodiment of the invention and in the drawing figures wherein:

FIG. 1 is an elevation view of the operative environment of the radially adjustable anvil roll assembly of the present invention;

FIG. 2 is an elevation view, in section, of the radially adjustable anvil roll assembly of the present invention;

DESCRIPTION OF THE PREFERRED EMBODIMENT

Figure 3:
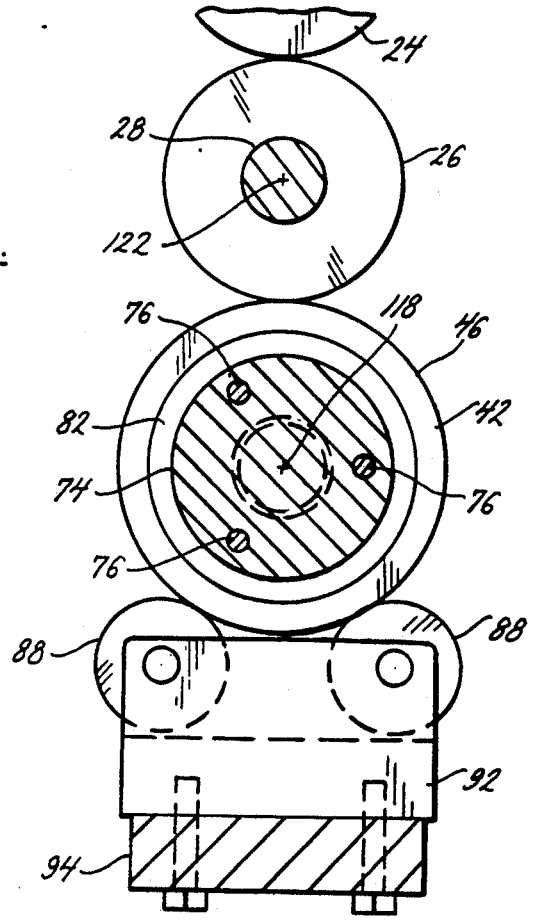
FIG. 3 is a side elevation view, in section, of the anvil roll assembly of the present invention taken along the line 3—3 of FIG. 1.

FIG. 1 shows a conventional die cutting press 12 employing the radially adjustable anvil roll assembly 14 and the adjustable bearer roll assembly 16 of the present invention. The press 12 includes a pressure bridge 18 supported across the top of the press by a pair of opposed side frame members 20. A pressure assist bar 22 is mounted between the side frame members 20 for vertical movement relative to the press. The pressure assist 22 rotatably supports a pair of load bearer rolls 24 that bear in continuous rolling contact with a pair of load bearer rolls 26 of a die cutting cylinder 28 mounted on the press. The pressure assist 22 is urged vertically downward as seen in FIG. 1 by the pair of jack screws 32 screw threaded through the pressure bridge 18 and engaging against a top surface of the pressure assist.

The die cutting cylinder 28 is mounted for rotation to the side frame members 20 by bearings 34. A gear 35 is secured to the die cutting cylinder for rotating the cylinder. The die cutting cylinder typically has a cutting die 36 formed on its exterior surface. The cutting die 36 is comprised of several cutting edges arranged in a predetermined configuration to continuously cut the desired product from a web of stock material passed through the press. The downward pressure applied on the pressure assist 22 by the jack screws 32 is transmitted to the die cutting cylinder 28 through the rolling engagement of the pressure assist load bearer rolls 24 and the die cutting cylinder load bearer rolls 26. This downward force urges the die cutting cylinder 28 downward toward the anvil roll assembly 14.

A drive pinion gear (not shown) is mounted for rotation on the right side frame member 20 of the press as seen in FIG. 1. The pinion gear is powered by a suitable motor source (not shown) that powers the die cutting press.

The radially adjustable anvil roll assembly 14 of the invention is mounted for rotation to the side frame members 20 of the press by bearings 38. The anvil roll assembly operates with the die cutting cylinder to cut the desired product in the web of stock material passed between the anvil roll and die cutting cylinder. As the web material is passed through the press, the downward force on the die cutting cylinder presses the cutting edges 36 of the die into the web material to the desired extent determined by the radial adjustment of the anvil roll assembly 14. By "radial adjustment" what is meant is the external or anvil surface of the anvil roll assembly is selectively adjusted toward or away from the die cutting cylinder of the press. The component parts of the radially adjustable anvil roll assembly 14 are shown in cross section in FIG. 2. The anvil roll assembly is comprised of a hollow cylindrical anvil sleeve 42, a shaft 44, a pair of bearer rolls 46, 48, and a driven gear 52.

Figure 4:
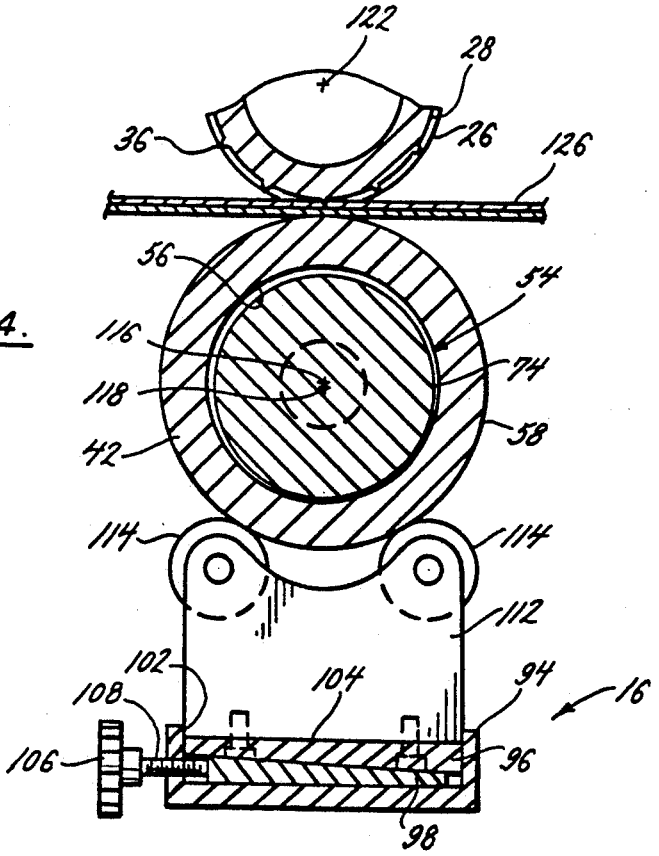
FIG. 4 is an elevation view, in section, of the anvil roll assembly of the present invention taken along the line 4—4 of FIG. 1.
Figure 5:
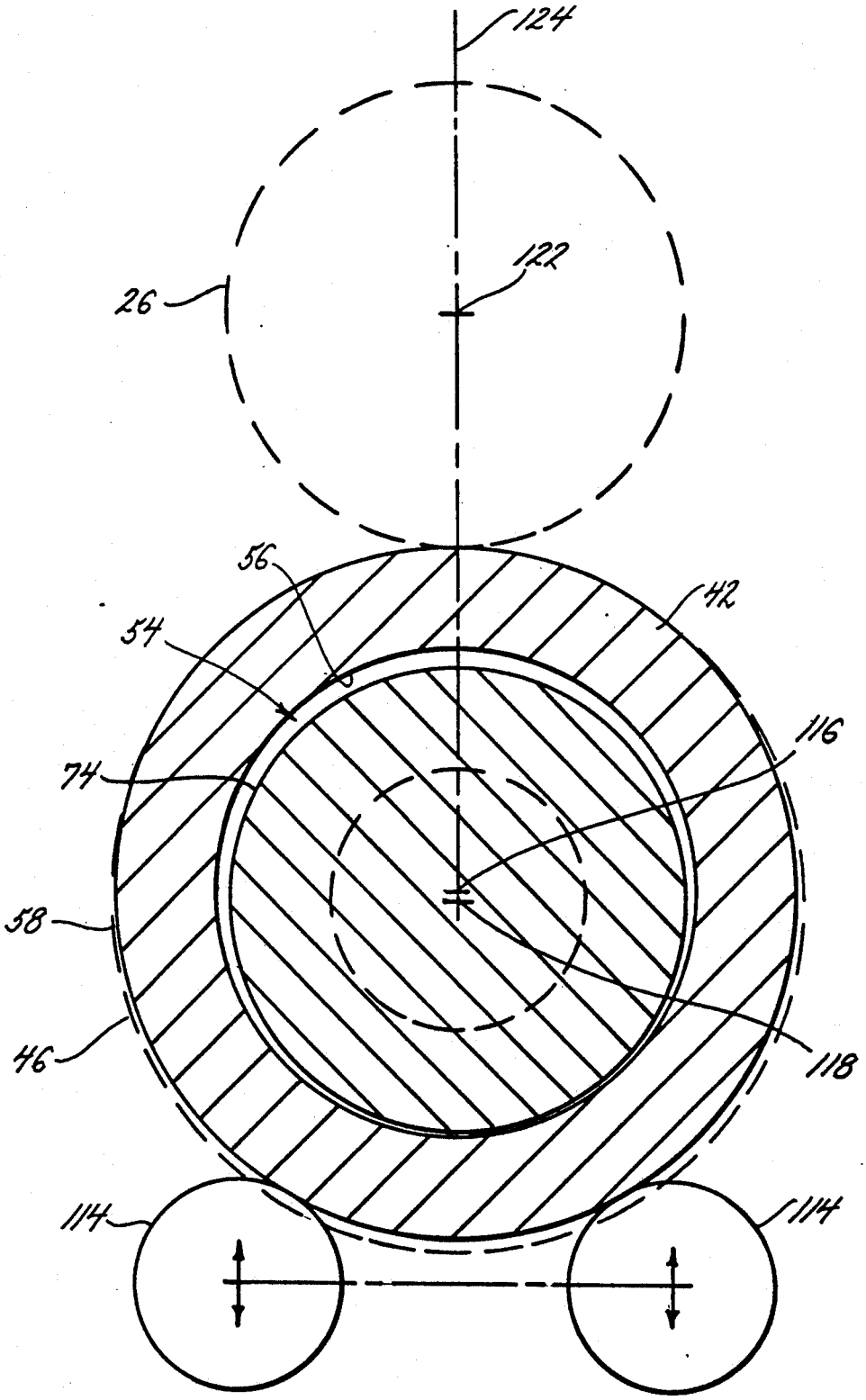
FIG. 5 is a side elevation view, in section, showing the degree of radial adjustment of the anvil roll of the present invention relative to a die cutting cylinder.

As shown in FIG. 2 and as visible in cross section in FIGS. 3–5, the anvil sleeve 42 is an elongate cylindrical sleeve having a hollow internal bore 54 defined by a cylindrical interior surface 56. The cylindrical exterior surface 58 of the sleeve serves as the anvil surface opposed by the cutting edges 36 of the die cutting cylinder 28. The left and right hand ends 62, 64 of the anvil sleeve, as viewed in FIG. 2, lie in planes that are perpendicular to the center axis of the sleeve.

The shaft 44 is an elongate rod having an axial length larger than the axial length of the anvil sleeve 42 and slightly larger than the width dimension of the rotary press 12. The shaft has an enlarged center portion 66 having a larger diameter than left 68 and right 72 end sections of the shaft projecting from the opposite ends of the center portion 66 as viewed in FIG. 2. The shaft center portion 66 has a cylindrical exterior surface 74 and a constant diameter across its axial length. The axial length of the center portion 66 is about equal to the axial length of the sleeve 42.

The opposite left and right hand end sections 68, 72 of the shaft project slightly beyond the frame members 20 on the opposite sides of the press. The left and right shaft end sections 68, 72 have reduced diameters from that of the shaft center portion 66 and also have substantially constant diameters along their axial lengths. The shaft end sections 68, 72 are journalled in the bearings 38 mounted on the frame members 20 of the press, thereby mounting the shaft for rotation on the press. The bearer rolls 46, 48 are mounted on the left and right shaft end sections 68, 72 respectively, and are secured to the shaft by screws 76, 78. Annular thrust bearings 82, 84 are positioned on the center portion of the shaft 66 between the anvil sleeve 42 and the left and right bearer rolls 46, 48. The driven gear 52 is secured by a key 86 to the right hand end section 72 of the shaft intermediate the right hand bearer roll 48 and the right hand bearing assembly 38 supporting the shaft.

As seen in FIG. 1, the anvil roll assembly 14 is mounted on the die cutting press 12 by the bearing assemblies 38. The bearer rolls 46, 48 secured to the anvil shaft 44 engage in rolling engagement between both the bearer rolls 26 of the die cutting cylinder 28, and pairs of bearer rolls 88 mounted for rotation on bearer blocks 92 secured to a base member 94 of the press 12. The driven gear 52 of the anvil roll assembly meshes with both the die cylinder gear 35 and the press drive pinion (not shown) to rotate the anvil shaft 44 and die cylinder 28 in synchronism with the drive pinion.

The adjustable bearing block assembly 16 is best seen in FIGS. 1 and 4 of the drawing figures. The assembly 16 includes a pair of wedge shaped plates 96, 98 positioned in a recess 102 of the press base member 94. As is best seen in FIG. 4, the inclined surfaces of the wedge shaped plates 96, 98 are positioned in sliding engagement against each other so that the top surface 104 of the top plate 96 is substantially horizontal and parallel with the top surface of the cutting press base member 94. Also seen in FIG. 4, the bottom plate 98 is not as wide as the top plate 96, enabling the bottom plate to slide forward and back beneath the top plate 96, or left to right as seen in drawing FIG. 4. A manual control knob 106 having a screw threaded shaft 108 is screw threaded through a hole in a side of the press base member 94 and is connected by a rotatable connection (not shown) to the edge of the bottom plate 98. By turning the manual knob 106 in a first direction, the threaded shaft 108 extends into the recess 102 and pushes the bottom plate 98 to the right as seen in FIG. 4, causing the top plate 96 to raise vertically. By turning the manual knob 106 in the opposite direction, the screw threaded shaft 108 is backed out of the recess 102, pulling the bottom plate 98 to the left as viewed in FIG. 4 and causing the top plate 96 to be vertically lowered.

A pair of bearer blocks 112 are secured to opposite left and right hand ends of the top surface 104 of the top plate 96. Each of the left and right bearer blocks 112 rotatably support a pair of bearer rolls 114. As is best seen in FIGS. 4 and 5, the bearer rolls 114 of each bearer block 112 are spaced from each other and engage in rolling engagement with the external surface 58 of the anvil sleeve 42.

The engagement of the four bearer rolls 114 with the exterior surface of the anvil sleeve 42 maintains the anvil sleeve in a position where the center axis 116 of the sleeve is positioned in a vertical plane also occupied by the center axis 118 of the anvil shaft 44 and the center axis 122 of the die cutting cylinder 28. As seen in FIG. 5, the bearer rolls 114 are positioned in front of and behind the vertical plane 124. This positioning of the bearer rolls 114 enables the bearer rolls to maintain the anvil sleeve 42, which is freely rotatable on the center portion of the shaft 44, in the vertical plane 124 containing the center axes of the die cutting cylinder 28, the anvil shaft 44, and the anvil sleeve 42.

By turning the manual knob 106 in the first direction and causing the top plate 96 of the bearing block assembly to be raised, the bearer rolls 114 of the bearing block assembly are also raised and moved in a direction toward the center axis 122 of the die cutting cylinder 28. The upward movement of the bearer rolls 114 toward the die cutting cylinder 28 also causes the anvil sleeve 42 to be raised vertically and moved toward the die cutting cylinder 28. The rolling engagement of the bearer rolls 114 with the exterior surface of the anvil sleeve 42 maintains the anvil sleeve center axis 116 in the vertical plane 124 occupied by the center axes of the anvil shaft and the die cutting cylinder, and moves the sleeve center axis 116 radially toward the center axis 122 of the die cutting cylinder. The movement of the anvil sleeve 42 toward the die cutting cylinder 28 decreases the space between the die cutting edges 36 of the cylinder and the exterior anvil surface 58 of the sleeve. This results in the cutting edges 36 of the die cutting cylinder 28 cutting deeper into the web material 124 passed between the anvil sleeve 42 and the die cutting cylinder 28.

By rotating the manual knob 106 in the opposite direction, causing the top plate 92 of the bearing assembly to be lowered, the bearer rolls 114 in rolling engagement with the anvil sleeve 42 are moved vertically away from the die cutting cylinder 28. The movement of the bearer rolls 114 away from the die cutting cylinder 28 causes the center axis 116 of the sleeve to move away from the center axis 122 of the cylinder. This movement of the sleeve axis relative to the cylinder axis causes the space between the cutting edges 36 of the die cutting cylinder and the exterior anvil surface 58 of the sleeve 42 to increase. By increasing the space between the cutting edges 36 of the die cutting cylinder 28 and the anvil surface 58 of the sleeve 42, the cuts made by the cylinder cutting edges 36 into the web material 126 passed between the cylinder and sleeve are adjusted so that they do not cut as far through the material as when the sleeve is adjusted toward the cylinder.

The radial adjustment of the anvil sleeve 42 relative to the die cutting cylinder 28 is limited by the difference between the internal diameter of the sleeve and the external diameter of the shaft center portion. By selectively raising and lowering the bearer rolls 114 of the bearer block assembly 16, the anvil sleeve is adjusted between a first position, shown in FIGS. 4 and 5, where the sleeve internal bore 56 engages against the underside of the shaft center portion 74 and the sleeve's center axis 116 is radially positioned closest to the center axis 122 of the die cutting cylinder 28, and a second position (not shown) where the surface 56 of the sleeve internal bore engages against the top of the shaft center portion 66 and the center axis of the sleeve 116 is radially spaced its furthest extent from the center axis 122 of the die cutting cylinder 28. By selectively raising and lowering the pair of bearer blocks 112 by adjusting the manual knob 106 of the bearer block assembly 16, the axis of rotation of the sleeve 116 and the sleeve external anvil surface 58 are radially adjusted toward and away from the cutting edges 36 of the die cutting cylinder 28.

Although the anvil sleeve of the present invention has been described as being radially adjustable toward and away from the die cutting cylinder of the rotary die cutting press, it should be understood that the die cutting cylinder may also be constructed in the manner described with regard to the anvil sleeve so that the die cutting cylinder is radially adjusted toward and away from the anvil surface of a conventional anvil roll.

While the present invention has been described by reference to a specific embodiment, it should be understood that modifications and variations of the invention may be constructed without departing from the scope of the invention defined in the following claims. For example, it should be understood that assemblies other than the bearing block assembly described may be employed to raise and lower the anvil sleeve radially relative to the die cutting cylinder of the press without departing from the intended scope of the claims.

What is claimed is:

1. A radially adjustable anvil roll assembly for use with a die cutting cylinder of a rotary die cutting press, the anvil roll assembly comprising:

a cylindrical sleeve having an interior bore;

a shaft extending longitudinally through the interior bore of the sleeve, the shaft being mounted for rotation on the rotary die cutting press in a fixed position on the press, and the shaft positioning the sleeve in a radially spaced position relative to the die cutting cylinder of the press;

means engaging the sleeve for adjustably positioning the sleeve on the shaft and for adjusting the radial spacing of the sleeve relative to the die cutting cylinder; and the cylindrical sleeve has an exterior surface and the means engaging the sleeve engages the exterior surface of the sleeve.

2. The anvil roll assembly of claim 1, wherein:

at least one bearer roll is provided on the shaft, the one bearer roll engages in rolling contact with a bearer roll of the die cutting cylinder, the one bearer roll is separate from the sleeve and the sleeve rotates on the shaft independent of the one bearer roll.

3. The anvil roll assembly of claim 1, wherein:

the interior bore of the sleeve has an inner diameter and the shaft has an outer diameter, and the inner diameter is sufficiently larger than the outer diameter to enable the sleeve to be displaced limited radial distances on the shaft toward and away from the die cutting cylinder.

4. The anvil roll assembly of claim 1, wherein:

the sleeve is freely rotatable on the shaft.

5. The anvil roll assembly of claim 1, wherein:

the means engaging the sleeve is supported on the press at an opposite side of the sleeve from the die cutting cylinder.

6. The anvil roll assembly of claim 1, wherein:

the means engaging the sleeve includes bearing means that engage in rolling contact with the exterior surface of the sleeve.

7. The anvil roll assembly of claim 1, wherein:

the engaging means is supported on the press and is adjustable on the press to selectively move toward and away from the die cutting cylinder of the press.

8. The anvil roll assembly of claim 1, wherein:

the engaging means includes at least one bearer block supported on the press, the bearer block being adjustable on the press to selectively move toward and away from the die cutting cylinder of the press, and the bearer block supporting a pair of bearer rolls that engage in rolling engagement with the exterior surface of the sleeve.

9. The anvil roll assembly of claim 1, wherein:

the engaging means includes a pair of separate bearer blocks supported on the press, the bearer blocks are adjustable together on the press to selectively move together toward and away from the die cutting cylinder of the press, and the bearer blocks each support a pair of bearer rolls that engage in rolling engagement with the exterior surface of the sleeve.

10. A radially adjustable anvil roll assembly for use with a die cutting cylinder of a rotary die cutting press, the anvil roll assembly comprising:

a cylindrical sleeve having an external surface, a hollow internal bore, and a longitudinal axis of rotation parallel to an axis of rotation of the die cutting cylinder;

a shaft extending through the internal bore of the sleeve, the shaft being mounted for rotation on the press and the shaft having a longitudinal axis of rotation parallel to the axis of rotation of the die cutting cylinder;

means provided on the press for adjusting a radial spacing of the axis of rotation of the sleeve relative to both the axis of rotation of the shaft and the axis of rotation of the die cutting cylinder; and the means for adjusting the radial spacing of the axis of rotation of the sleeve bears against the external surface of the sleeve.

11. The anvil roll assembly of claim 10, wherein:

the means for adjusting the radial spacing of the axis of rotation of the sleeve includes a pair of separate bearer blocks supported in axially spaced positions on the press for selective movement together toward and away from the die cutting cylinder of the press, and the bearer blocks each support a pair of bearer rolls that engage in rolling engagement with the external surface of the sleeve.

12. The anvil roll assembly of claim 10, wherein:

the axes of rotation of the die cutting cylinder, the shaft, and the sleeve are coplanar, and the means for adjusting the radial spacing of the axis of rotation of the sleeve relative to the axes of rotation of the cylinder and shaft adjusts the axis of rotation of the sleeve radially between a first position intermediate the axis of rotation of the die cutting cylinder and the axis of rotation of the shaft, and a second position at an opposite side of the axis of rotation of the shaft from the axis of rotation of the die cutting cylinder.

13. The anvil roll assembly of claim 12, wherein:

the means for adjusting the radial spacing of the axis of rotation of the sleeve relative to the axes of rotation of the cylinder and shaft adjusts the radial spacing of the axis of rotation of the sleeve continuously between the first and second positions.

14. The anvil roll assembly of claim 10, wherein:

the means for adjusting the radial spacing of the axis of rotation of the sleeve includes at least one bearer block supported on the press for selective movement toward and away from the die cutting cylinder of the press, and the bearer block supports a pair of bearer rolls that engage in rolling engagement with the external surface of the sleeve.

15. The anvil roll assembly of claim 10, wherein:

a pair of bearer rolls are secured to the shaft at opposite longitudinal ends of the sleeve, and the means for adjusting the radial spacing of the axis of rotation of the sleeve bears against the external surface of the sleeve between the pair of bearer rolls.

16. A radially adjustable anvil roll assembly for use with a die cutting cylinder of a rotary die cutting press, the anvil roll assembly comprising:

a cylindrical sleeve having an exterior surface, an interior bore and a longitudinal center axis parallel to a center axis of the die cutting cylinder of the press;

a shaft extending through the interior bore of the sleeve and positioning the sleeve for rotation on the shaft in a radially spaced position relative to the die cutting cylinder of the press, the shaft having a center axis parallel to the center axis of the die cutting cylinder of the press and the shaft being mounted for rotation in a fixed position on the press;

means provided on the press and engaging the sleeve for adjusting a radial spacing of the sleeve center axis from the die cutting cylinder center axis by selectively moving the sleeve toward and away from the die cutting cylinder; and the means for adjusting the radial spacing of the sleeve axis engages with the exterior surface of the sleeve.

17. The anvil roll assembly of claim 16, wherein:

the means for adjusting the radial spacing of the sleeve axis includes a pair of rollers in rolling engagement with the exterior surface of the sleeve, the pair of rollers are mounted on the press for adjustable movement toward and away from the cutting cylinder of the press.

18. A radially adjustably anvil roll assembly for use with a die cutting cylinder of a rotary die cutting press, the anvil roll assembly comprising:

a cylindrical sleeve having an exterior surface, an interior bore and a longitudinal center axis parallel to a center axis of the die cutting cylinder of the press;

a shaft extending through the interior bore of the sleeve and positioning the sleeve for rotation on the shaft in a radially spaced position relative to the die cutting cylinder of the press, the shaft having a center axis parallel to the center axis of the die cutting cylinder of the press and the shaft being mounted for rotation in a fixed position on the press;

bearer rolls mounted on opposite ends of the shaft to bear against the die cutting cylinder and support and position the die cutting cylinder relative to the shaft, and to position the sleeve in a longitudinally spaced position between the bearer rolls on the shaft;

means provided on the press and engaging the sleeve for adjusting a radial spacing of the sleeve center axis from the die cutting cylinder axis by selectively moving the sleeve toward and away from the die cutting cylinder; and, the means for adjusting the radial spacing of the sleeve axis engages with the exterior surface of the sleeve.

19. The anvil roll assembly of claim 18, wherein:

the means for adjusting the radial spacing of the sleeve axis includes a pair of rollers in rolling engagement with the exterior surface of the sleeve, the pair of rollers are mounted on the press for adjustable movement toward and away from the cutting cylinder of the press.

20. A radially adjustable anvil roll assembly for use with a die cutting cylinder of a rotary die cutting press, the anvil roll assembly comprising:

a cylindrical sleeve having an interior bore;

a shaft extending longitudinally through the interior bore of the sleeve, the shaft being mounted for rotation on the rotary die cutting press in a fixed position on the press;

bearer rolls mounted on opposite ends of the shaft to bear against a die cutting cylinder and support and position the die cutting cylinder relative to the shaft, and to position the sleeve in a longitudinally spaced position between the bearer rolls on the shaft;

means engaging the sleeve for adjusting a radial spacing of the sleeve relative to the die cutting cylinder; and, the cylindrical sleeve has an exterior surface and the means engaging the sleeve engages the exterior surface of the sleeve.

21. The anvil roll assembly of claim 20, wherein:

the means engaging the sleeve is supported on the press at an opposite side of the sleeve from the die cutting cylinder.

22. The anvil roll assembly of claim 20, wherein:

the bearer rolls engage in rolling contact with the die cutting cylinder and are separated from the sleeve on the shaft with the sleeve rotating independent of the bearer rolls on the shaft.

23. The anvil roll assembly of claim 20, wherein:

the interior bore of the sleeve has an inner diameter and the shaft has an outer diameter, and the inner diameter of the sleeve is sufficiently larger than the outer diameter of the shaft to allow the sleeve to be displaced radially relative to the shaft without contacting the outer diameter of the shaft.

24. The anvil roll assembly of claim 20, wherein:

the sleeve is freely rotatable on the shaft between the bearer rolls.

25. A radially adjustable anvil roll assembly for use with a die cutting cylinder of a rotary die cutting press, the anvil roll assembly comprising;

a cylindrical sleeve having an external surface, a hollow internal bore, and a longitudinal axis of rotation parallel to an axis of rotation of the die cutting cylinder;

a shaft extending through the internal bore of the sleeve, the shaft being mounted for rotation on the press and the shaft having a longitudinal axis of rotation parallel to the axis of rotation of the die cutting cylinder;

bearer rolls mounted on opposite ends of the shaft in a longitudinally spaced relationship to engage in rolling contact with the die cutting cylinder, the sleeve being positioned between the bearer rolls on the shaft;

means provided on the press for adjusting a radial spacing of the axis of rotation of the sleeve relative to both the axis of rotation of the shaft and the axis of rotation of the die cutting cylinder; and, the means for adjusting the radial spacing of the axis of rotation of the sleeve bears against the external surface of the sleeve.

26. The anvil roll assembly of claim 25, wherein:

a pair of bearer rolls are secured to the shaft at opposite longitudinal ends of the sleeve, and the means for adjusting the radial spacing of the axis of rotation of the sleeve bears against the external surface of the sleeve between the pair of bearer rolls.

27. The anvil roll assembly of claim 25, wherein:

the means for adjusting the radial spacing of the axis of rotation of the sleeve includes at least one bearer block supported on the press for selective movement toward and away from the die cutting cylinder of the press, and the bearer block supports a pair of bearer rolls that engage in rolling engagement with the external surface of the sleeve.

28. The anvil roll assembly of claim 25, wherein:

the axes of rotation of the die cutting cylinder, the shaft, and the sleeve are coplanar, and the means for adjusting the radial spacing of the axis of rotation of the sleeve relative to the axes of rotation of the cylinder and shaft adjusts the axis of rotation of the sleeve radially between a first position intermediate the axis of rotation of the die cutting cylinder and the axis of rotation of the shaft, and a second position at an opposite side of the axis of rotation of the shaft from the axis of rotation of the die cutting cylinder.

29. The anvil roll assembly of claim 28, wherein:

the means for adjusting the radial spacing of the axis of rotation of the sleeve relative to the axes of rotation of the cylinder and shaft adjusts the radial spacing of the axis of rotation of the sleeve continuously between the first and second positions.

30. The anvil roll assembly of claim 25, wherein:

the means for adjusting the radial spacing of the axis of rotation of the sleeve includes a pair of separate bearer blocks supported in axially spaced positions on the press for selective movement together toward and away from the die cutting cylinder of the press, and the bearer blocks each support a pair of bearer rolls that engage in rolling engagement with the external surface of the sleeve.

* * * * *